US006056985A

United States Patent [19]

Fluckiger et al.

[11] Patent Number: 6,056,985

[45] Date of Patent: May 2, 2000

[54] FOODSTUFF PACKAGE, PROCESS AND DEVICE FOR HEAT-TREATING A FOODSTUFF VACUUM-PACKED IN SUCH A PACKAGE

[75] Inventors: Rudolf Fluckiger, Richterswil; Nicole Oehninger, Olten; Beat Gehrig, Weiningen, all of Switzerland

[73] Assignee: Gate Gourmet Zurich AG, Zurich-Flughafen, Switzerland

[21] Appl. No.: 09/077,041

[22] PCT Filed: Dec. 12, 1996

[86] PCT No.: PCT/CH96/00435

§ 371 Date: May 18, 1998

§ 102(e) Date: May 18, 1998

[87] PCT Pub. No.: WO97/22537

PCT Pub. Date: Jun. 26, 1997

[30] Foreign Application Priority Data

Dec. 20, 1995 [CH] Switzerland ..... 3608/95
Dec. 20, 1995 [CH] Switzerland ..... 3609/95

[51] Int. Cl.[7] ..... A23L 3/10

[52] U.S. Cl. ..... 426/392; 426/106; 426/231; 426/232; 426/412; 99/483; 99/493; 374/137; 374/141; 374/159; 374/186; 53/427; 53/428; 53/432; 53/440

[58] Field of Search ..... 426/106, 113, 426/132, 231, 232, 412, 88, 383, 392; 99/342, 493, 483; 374/137, 141, 159, 186; 53/427, 428, 432, 440

[56] References Cited

U.S. PATENT DOCUMENTS

| | | | |
|---|---|---|---|
| 842,981 | 2/1907 | Tagliabue | 374/186 |
| 3,964,313 | 6/1976 | Connick | 73/343 |
| 4,003,124 | 1/1977 | Connick | 29/460 |
| 4,036,995 | 7/1977 | Koether et al. | 426/233 |
| 4,104,916 | 8/1978 | Hofer | 73/343 B |
| 4,340,610 | 7/1982 | Nioras | 426/88 |
| 4,595,487 | 6/1986 | Nunlist | 204/433 |
| 4,808,381 | 2/1989 | McGregor et al. | 422/100 |
| 4,852,916 | 8/1989 | Johnson | 285/187 |
| 5,199,297 | 4/1993 | Lin et al. | 73/52 |
| 5,407,641 | 4/1995 | Katschnig et al. | 422/107 |
| 5,784,401 | 7/1998 | Suzuki et al. | 374/137 |

FOREIGN PATENT DOCUMENTS

| | | |
|---|---|---|
| 132 666 | 2/1985 | European Pat. Off. . |
| 509 281 | 10/1992 | European Pat. Off. . |
| 1 195 250 | 11/1959 | France . |
| 2 603 777 | 3/1988 | France . |
| 3544244 | 6/1987 | Germany . |
| 8-70201502 | 8/1987 | Japan . |
| 747 794 | 4/1956 | United Kingdom . |

*Primary Examiner*—Milton Cano
*Attorney, Agent, or Firm*—Sughrue, Mion, Zinn, Macpeak & Seas, PLLC

[57] ABSTRACT

To find the core temperature of the foodstuff, the package can be fitted with an aperture (3) through which a temperature sensor (11) is inserted into the foodstuff. The temperature sensor is connected to a temperature detection instrument at an end projecting from the aperture (3) and the foodstuff heated to the predetermined temperature, the temperature curve being stored in the temperature detection instrument so as to be fetched. For cooling, the foodstuff with the sensor is, for example, taken out of the oven and reconnected to the temperature detector, in which the temperature curve during cooling is stored so as to be fetched.

19 Claims, 3 Drawing Sheets

Figure 1B:
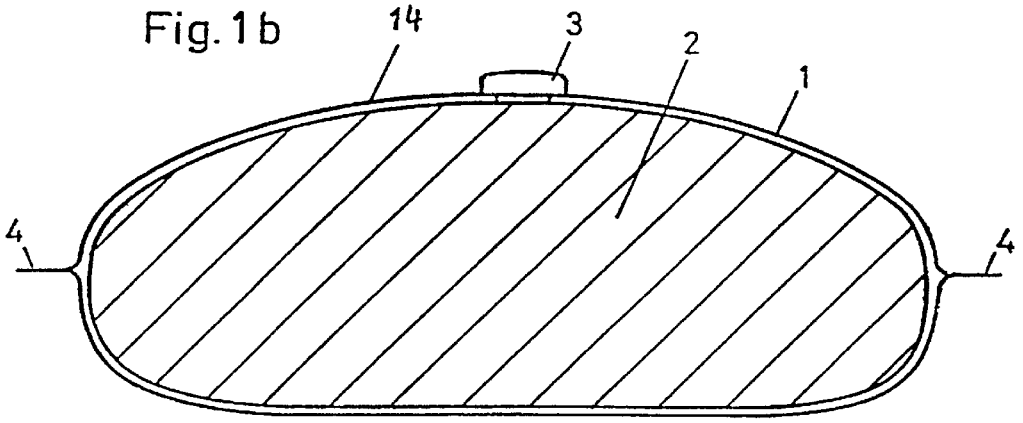

FOODSTUFF PACKAGE, PROCESS AND DEVICE FOR HEAT-TREATING A FOODSTUFF VACUUM-PACKED IN SUCH A PACKAGE

The invention involves a food packaging with a sealable wrapping that is flexible, can have the air evacuated and can be heated to at least the pasteurization temperature. Such packaging has been used for a long time in large institutional kitchens to pasteurize food, like vegetables, meat, sauces and similar items, under the brand, "Sous-Vide Bag". This packaging is a heat shrinking bag which can have the air removed after filling with the item to be pasteurized and then be sealed in an air-tight manner.

A chicken breast can, for example, be pasteurized with such a bag, in that it is warmed to a core temperature of 75° C. in a suitable oven or water bath and then cooled as rapidly as possible in an ice water bath of less than 8° C. The process is known as the Sous-Vide Process and has proven itself, since the cooking loss can be reduced to about 50% under hygienic conditions. There is the problem with this packaging, that direct observation and indication of the temperature in the core of the cooked item is not possible.

The invention has the task of creating a packaging of the named type in which the above named problem can be avoided. The packaging should nonetheless be producible at a favorable cost and completely guarantee hygienic conditions for the food.

The task is solved by a food packaging of this type according to the present invention. The packaging of the invention makes possible the emplacement of a temperature sensor which can be introduced into the item to be pasteurized by means of a simple pass-through. A temperature acquisition device of a previously known type can be connected to the protruding end of the sensor and thus register exactly and document the temperature course in the core during heating and cooling. The temperature data can thus be acquired and printed at any time, for example, in the form of a time/temperature curve or it can be displayed on a monitor. The implanted temperature sensor also makes possible an optimum control of the temperature course and thus optimum heating and cooling with minimal use of energy.

The food packaging is preferably a bag and in particular a heat shrinking bag capable of withstanding temperatures up to about 110° C. Other variations, however, are also conceivable in which only a partial area of the packaging manifests a wrapping or a foil. It is essential that the pass-through remains sealed after the temperature sensor is removed.

In another embodiment of the invention the sealing element and the wrapping pulled over it is pushed by a ring. The ring is preferably positioned on the outside of the wrapping and the sealing element on the inside of the wrapping. This makes possible a simple and hygienic mounting of the pass-through.

The invention also involves a process for heating a food item, in particular to pasteurize a vacuum-packed food item packaged according to the present invention, whereby it is warmed, for example, in an oven or a water bath to a predetermined temperature and then is cooled.

Such a process is known in the current state of technology under the name "Sous-Vide Process". It is primarily used in large institutional kitchens and has proven itself. In this process a food item, like a vegetable or meat, is vacuum-sealed in a plastic bag after appropriate preparation and heated to the pasteurization temperature in an oven or water bath and then the bag is cooled as rapidly as possible to less than 8° C. in an ice water bath or with liquid nitrogen or carbon oxide and stored at 0 to 2° C. It is thereby essential, that the required core temperature be attained. That amounts for a chicken breast, for example, to about 75° C. This process has the advantage that cooking loss can be reduced to about 50% under hygienic conditions and less vitamins and minerals are lost than was previously the case, and with the above named temperature a storage time of at least two weeks can be achieved. For the observation of the core temperature it is previously known how to seal a thermometer in the bag which measures the temperature of the core. The thermometer can be read through the transparent wrapping of the bag. The course of the temperature during pasteurization can be obtained by a regular reading of the thermometer and the completion of a report which allows the course of the temperature to be documented. This, however, requires a lot of effort and can only be accomplished in a step-by-step manner. These problems are avoided in the process according to a further embodiment of the present invention.

Other advantages can be seen from the following description of a preferred embodiment and the drawings.

Figure 1A:
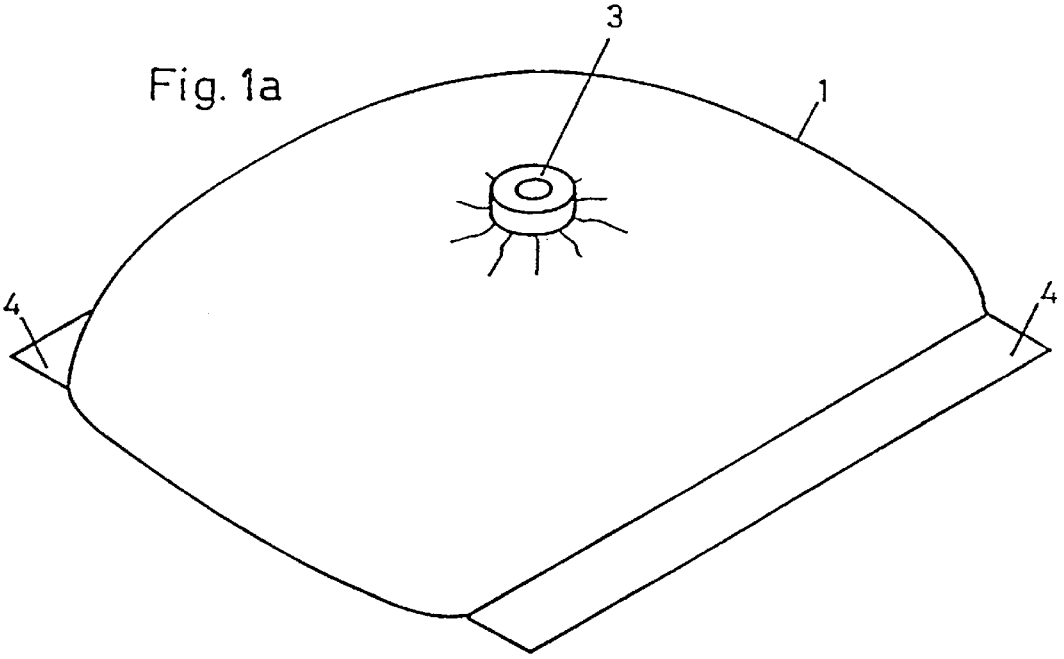
Figure 5:
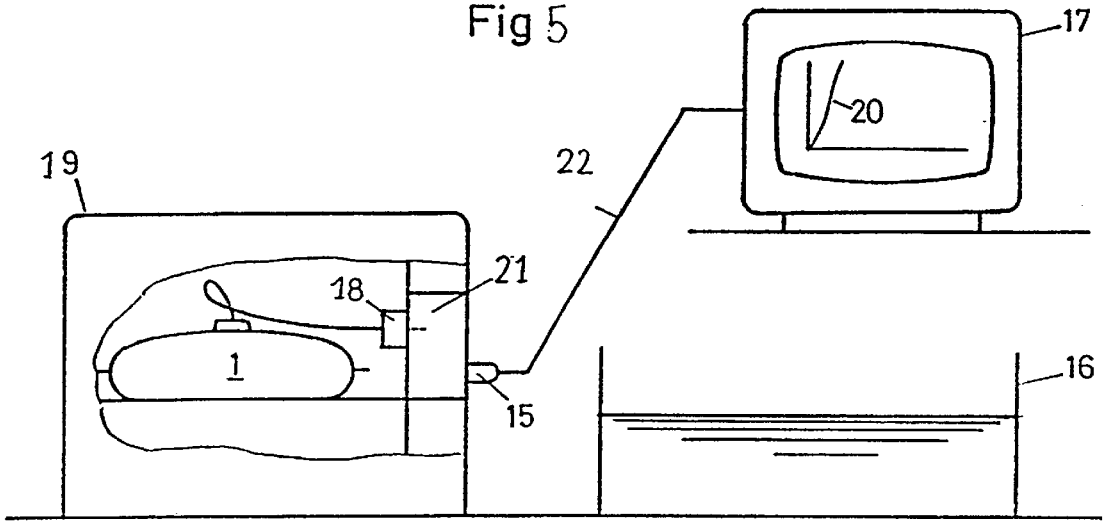
Figure 6:
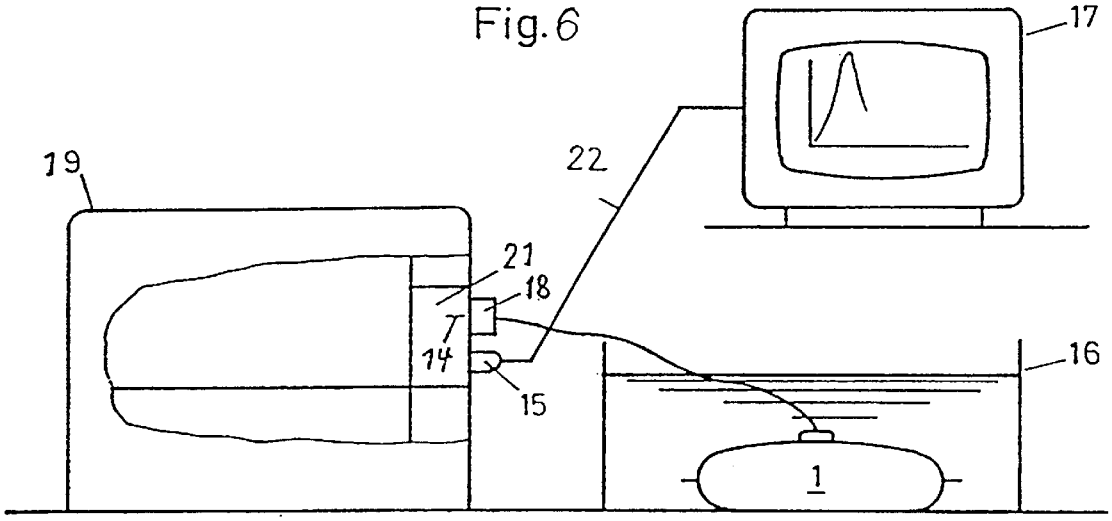
Figure 7:
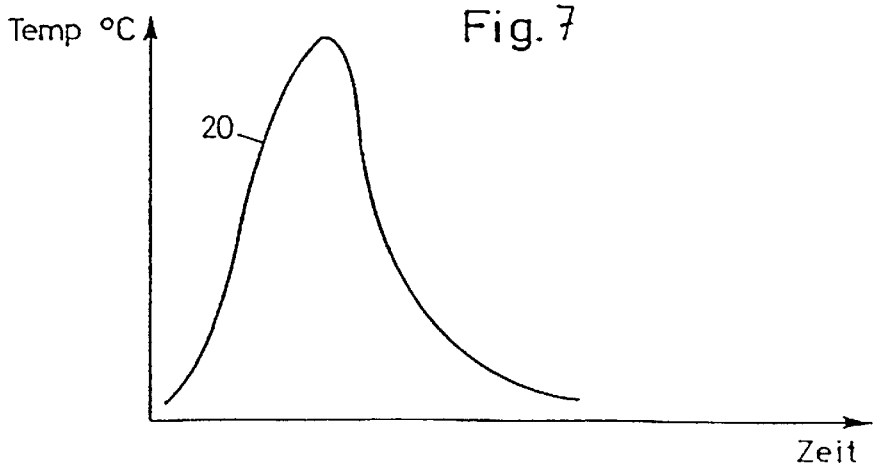

An embodiment of the invention will be explained more closely in the following section based on the drawings. Shown are:

FIG. 1*a* & 1*b*: A front view and cut-away view of the packaging of the invention FIG. 2: The individual parts of the pass-through prior to its mounting FIG. 3*a* to 3*g*: The individual steps for mounting the pass-through FIG. 4: A schematic partial cut-away of an example of the packaging in the invention with a mounted thermal sensor FIG. 5 & 6: A schematic device to perform the process, and FIG. 7: The temperature course during pasteurization of a food item.

FIGS. 1*a* and 1*b* show a bag 1 with food item 2 sealed in an air-tight manner. The bag basically consists of a foil-like wrapping 14 made of suitable, preferably transparent, plastic which is sealed by means of sealing seams 4. A pass-through 3 for a thermal sensor 11 (FIG. 4) is secured to the wrapping 14 at a suitable location. The pass-through will be explained in more detail in the following section.

Figure 2:
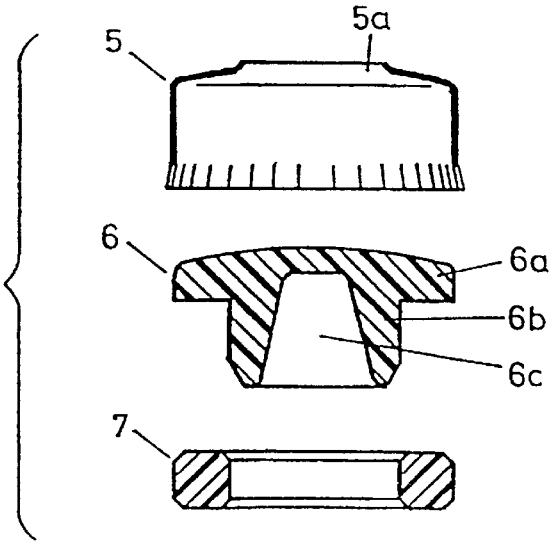

As seen in FIG. 2 the pass-through 3 consists of a hat or plate-shaped sealing member 6 with a circular edge 6*a*, a ring-shaped projection 6*b* and a recess 6*c* on the bottom side. To secure this sealing member 6 to the wrapping, the pass-through incorporates a locking member 5 as well as a ring 7. As can be seen, the locking member 5 is constructed with a shell-shape and incorporates an inward extending edge 5*b* and an upper opening 5*a*. The locking element may be formed from aluminum The ring 7 is preferably made of plastic, for example TEFLON, and is so shaped, that the projection 6*b* engages into the ring 7. The sealing element 6 with the ring 7 already emplaced can be inserted from below into the locking element 5.

The mounting procedure for the pass-through will be explained in the following section using FIGS. 3*a* to 3*g*.

The mounting is preferably done while wearing rubber gloves in hygienically clean surroundings. The sealing member 6 preferably made of natural non-vulcanized rubber is sterilized in an autoclave prior to mounting. Automatic mounting is, however, also possible.

Figure 3A:
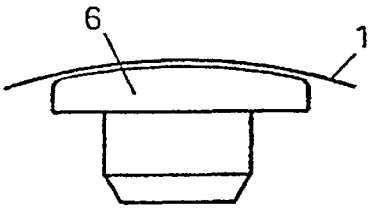
Figure 3B:
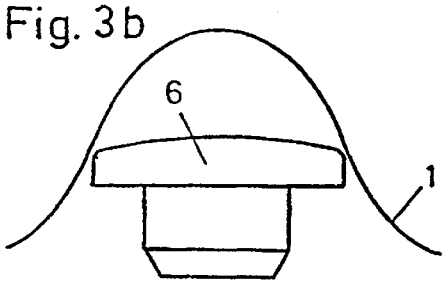

In the first cut-away view the sealing member 6 is placed in the desired position inside the bag. A sack 14*a* is formed around the sealing member 6 on the outside of the wrapping 14, as shown in FIG. 3*b*.

Figure 3C:
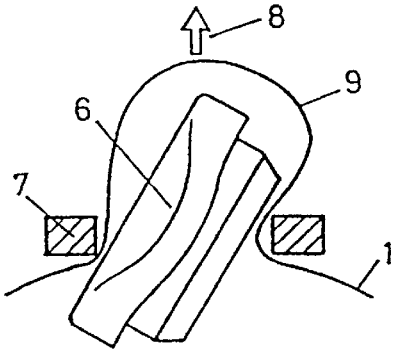

The sealing member 6 is now pressed together with two fingers and pushed through the ring 7, in the direction of arrow 8 as shown in FIG. 3*c*.

Figure 3D:
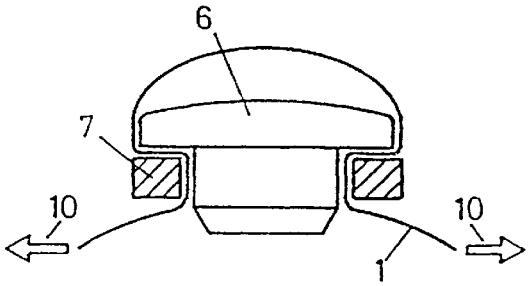
Figure 3E:
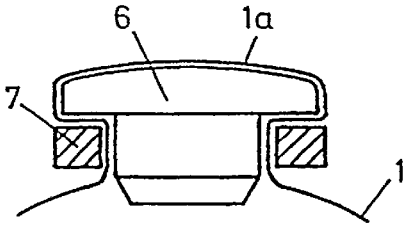
Figure 3F:
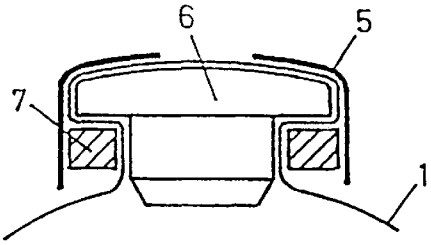
Figure 3G:
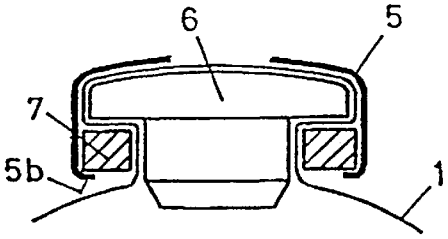

The wrapping 14 is next smoothed out by pulling in the direction of the arrow 10 and the sealing member 6 is pushed into the ring 7, so that the arrangement shown in FIG. 3*d* is achieved.

The locking element 5 is emplaced from above on the sealing member 6 and the ring 7, and then the locking element 5 is so pressed using a suitable pressing tool, that it rests tightly on the wrapping 14, sealing member 6 and surrounding the ring 7 with an inward protruding edge 5*b*. The bag 1 is thus ready to use and can be filled, have the air removed, and finally be sealed. The contents of the bag 1 then come in contact with the inside of the wrapping 14 as well as the sealing member 6. The locking member 5 may be fixedly connected with the sealing member 6 by a form lock. The locking member 5 may also comprise a press-on cap.

Figure 4:
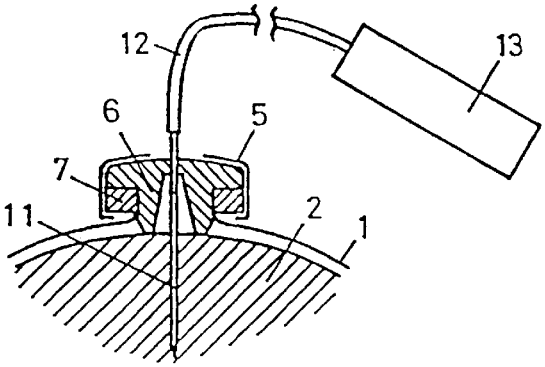

To mount the thermal sensor 11 it is pushed through the opening 5*a* of the locking element 5, the wrapping 14 and the sealing member 6 into the contents of the bag 1. As shown in FIG. 4, the front end 11*a* extends into the food item 2. The external end of the sensor 11 is connected to a temperature indicator 13 by means of a line 12. That device can acquire the temperature at the front end 11*a* of the sensor 11 and register it. Such acquisition devices are already known.

In order to pasteurize the food 2, the temperature sensor 11 is inserted through the pass-through 3 into the food in such a way, that the core temperature of the food 2 is measured. The bag 1 with the emplaced temperature sensor 11 is then placed in an oven 19 or a suitable water bath and the sensor 11 is connected to the temperature acquisition device 21 by means of a line 22 and a plug 18. The device 21 is preferably attached to an oven 19 and acquires the temperature present in the core of the food item 2. The device stores the temperature data and transmits it to the monitor 17 or a printer via a connection 15 and a line 22. The course of the temperature in the core of the food item 2 is displayed on the monitor 17, for example as a curve 20. If the predetermined temperature, for example 75° C., is reached, the plug 18 on the end of the temperature sensor 11 is withdrawn from the device and the bag 1 with the sensor 11 is removed from the oven 19. During cooling the plug 18 is again electrically connected to the temperature acquisition device 21 at a connection 14 on the outside of the oven 19 and the bag 1 is placed in an ice water bath 16. The core temperature in the food item 2 drops here relatively quickly, for example, to 8° C., as can be seen from the temperature course in FIG. 6. During cooling the temperature course is displayed on the monitor 17 via the temperature acquisition device 21 and the line 22.

If the food item 2 has cooled, the temperature sensor 11 is removed from bag 1 and the plug 18 is removed from the device 19. The food item is now pasteurized and can be further processed in a known manner. The temperature sensor 11 is disinfected and used for another activity. The measured temperature course is suitably stored and can later be displayed or printed. The temperature data and the bag 1 are identified with an appropriate designation, so that even at a later time a check of the documentation for the temperature course is possible at any time. The acquisition of the temperature course makes possible a check of the oven 19, whereby safety is further improved and energy use can be kept at a minimum. Storage of the cooled food item occurs in a refrigerator or walk-in cooling room which guarantees a temperature range of 0 to 2° C. If the temperature range is exceeded, an alarm sounds. In addition, the temperature course is constantly recorded on a so-called "logger" and checked weekly.

We claim:

1. A package for heat treating a food product comprising:

a flexible, vacuum sealable wrapping having an inside portion and an outside portion; and a pass-through device emplaced on the wrapping, said pass-through device including:

a sealing member operable for allowing a temperature sensor to pass through the device and into the food product;

a ring for securely engaging the wrapping against the pass through device; and a locking member for locking the sealing member, wrapping and ring.

2. The package according to claim 1, wherein the sealing member is constructed in a plate shape.

3. The package according to claim 1, wherein the sealing member comprises a rubbery elastic material.

4. The package according to claim 3 wherein the rubbery elastic material comprises rubber.

5. The package according to claim 1, wherein the locking member is constructed in a shell-shape.

6. The package according to claim 1, wherein the locking member is manufactured out of aluminum.

7. The package according to claim 1, wherein the locking member engages an edge in a locked configuration with the ring.

8. The package according to claim 1, wherein a pass-through opening in the locking member is disposed over an area of the wrapping, said wrapping being disposed over an area of the sealing member.

9. The package according to claim 1, wherein the wrapping is sealed in the area of the pass-through device at least between the sealing member and the ring and between the sealing member and the locking member.

10. The package according to claim 1, wherein the locking member fixedly connects the sealing member to the wrapping by a form-lock.

11. The package according to claim 1, wherein the sealing member is positioned on the inside portion of the of the wrapping and the locking member is position on the outside portion of the wrapping.

12. The package according to claim 1, wherein the wrapping is a bag.

13. The package according to claim 1, wherein the wrapping is a heat shrinking bag.

14. The package according to claim 1, wherein the locking member is a press-on cap.

15. The package according to claim 14, wherein the cap is pressed on at least one lower edge.

16. A process for heating a food product in a package comprising the steps of:

providing a food product in a package including:

a flexible, sealable wrapping having an inside portion and an outside portion, the food product packed under vacuum therein; and a pass-through device emplaced on the wrapping, said pass-through device including:

a sealing member operable for allowing a temperature sensor to pass through the device and into the food product;

a ring for securely engaging the wrapping against the pass through device; and a locking member for locking the sealing element, wrapping and ring;

warming the packed food product in at least one of an oven and a water bath to a predetermined temperature;

obtaining a core temperature of the packed food product using a temperature sensor inserted through the pass-through device positioned in the package, and into the packed food product, the temperature sensor being attached to a temperature acquisition device to obtain a temperature course during the warming of the packed food product to the predetermined temperature;

removing the packed food product from said at least one of an oven and a water bath; disconnecting the temperature sensor from the temperature acquisition device;

cooling the packed food product; and reconnecting the temperature sensor to the temperature acquisition device to obtain a temperature course during the cooling step.

17. The process for heating a food product in a package according to claim 16 further comprising the step of removing the sensor from the packed food product after cooling step and maintaining a vacuum-sealed packaging after removal of the sensor.

18. The process according to claim 16, wherein during the warming step, the temperature acquisition device and the temperature sensor are connected together on an internal surface of the oven or water bath and wherein during the cooling step, the temperature sensor is replugged with said temperature acquisition device via a connection external of the oven or water bath.

19. An assembly for heating a food product vacuum-packed in a package, the assembly comprising:

a flexible, sealable package containing a food product vacuum packed therein, the package comprising: a wrapping, a pass-through device emplaced on the wrapping, said pass-through device including:

a sealing member operable for allowing a temperature sensor to pass through the device and into a food product;

a ring for securely engaging the wrapping against the pass-through device; and a locking member for locking the sealing element, wrapping and ring;

a temperature sensor insertable through the pass-through device in the wrapping and into the food product; and a temperature acquisition device attached to at least one of an oven and a water bath and connected to the temperature sensor to acquire a temperature course.

* * * * *